US008034523B2

(12) United States Patent
Hasegawa et al.

(10) Patent No.: US 8,034,523 B2
(45) Date of Patent: Oct. 11, 2011

(54) FULL COLOR TONER, AND ITS USE IN ELECTROPHOTOGRAPHY METHODS AND APPARATUS

(75) Inventors: Kumi Hasegawa, Numazu (JP); Mitsuo Aoki, Numazu (JP); Minoru Masuda, Numazu (JP); Hyo Shu, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 621 days.

(21) Appl. No.: 11/195,825

(22) Filed: Aug. 3, 2005

(65) Prior Publication Data

US 2006/0051692 A1 Mar. 9, 2006

(30) Foreign Application Priority Data

Aug. 3, 2004 (JP) ..... 2004-227177

(51) Int. Cl.
*G03G 15/01* (2006.01)

(52) U.S. Cl. ..... 430/109.3; 430/42.1; 430/108.1; 430/108.4; 430/109.4; 430/124.1

(58) Field of Classification Search ..... 430/42.1, 430/108.1, 108.4, 109.3, 124.1, 109.4, 107.1
See application file for complete search history.

(56) References Cited

U.S. PATENT DOCUMENTS 5,478,686 A * 12/1995 Kawakami et al. ..... 430/109.4
5,622,804 A * 4/1997 Matsuoka et al. ..... 430/115
6,506,530 B1 * 1/2003 Kido et al. ..... 430/108.8
6,811,944 B2 11/2004 Higuchi et al.
6,813,461 B2 11/2004 Higuchi et al.
6,911,289 B2 6/2005 Higuchi et al.
6,992,150 B2 1/2006 Nakanishi et al.
2001/0049068 A1 * 12/2001 Iemura et al. ..... 430/108.3
2003/0027074 A1 * 2/2003 Emoto et al. ..... 430/124
2003/0049553 A1 * 3/2003 Nakamura et al. ..... 430/108.21
2003/0129517 A1 * 7/2003 Hotta et al. ..... 430/108.22
2003/0165760 A1 9/2003 Higuchi et al.
2003/0203302 A1 * 10/2003 Kanamaru et al. ..... 430/108.2
2003/0207192 A1 * 11/2003 Hirota et al. ..... 430/108.4
2003/0219670 A1 * 11/2003 Sawada et al. ..... 430/109.4
2004/0161688 A1 * 8/2004 Itakura et al. ..... 430/108.4
2004/0166429 A1 * 8/2004 Higuchi et al. ..... 430/111.4
2005/0026056 A1 * 2/2005 Fujikawa et al. ..... 430/45

FOREIGN PATENT DOCUMENTS

EP 0495476 A1 1/1992
EP 0898204 A1 2/1999
EP 2002023424 1/2002
EP 2004191516 7/2004

(Continued)

OTHER PUBLICATIONS

U.S. Appl. No. 11/408,031, filed Apr. 21, 2006, Shu, et al.

(Continued)

*Primary Examiner* — Christopher Rodee
*Assistant Examiner* — Rachel Zhang
(74) *Attorney, Agent, or Firm* — Oblon, Spivak, McClelland, Maier & Neustadt, L.L.P.

(57) ABSTRACT

A full color toner containing a binder resin, a release agent and a colorant is provided, wherein the binder resin contains a polyester resin containing a hybrid resin containing one or more vinyl group polymer units and one or more polyester units, and wherein the content A of the hybrid resin and the content B of the release agent satisfy the following relationship: $B/2 \leqq A \leqq 3B$.

10 Claims, 2 Drawing Sheets

FOREIGN PATENT DOCUMENTS

| | | |
|---|---|---|
| JP | 41-20153 | 11/1941 |
| JP | 43-27596 | 11/1943 |
| JP | 44-6397 | 3/1944 |
| JP | 45-26478 | 9/1945 |
| JP | 53-127726 | 11/1978 |
| JP | 57-167033 | 10/1982 |
| JP | 04-362956 | 12/1992 |
| JP | 05-061242 | 3/1993 |
| JP | 07-098511 | 4/1995 |
| JP | 08-220808 | 8/1996 |
| JP | 09-106105 | 4/1997 |
| JP | 09-304964 | 11/1997 |
| JP | 10-293425 | 4/1998 |
| JP | 2000-098661 | 4/2000 |
| JP | 2000-214638 | 4/2000 |
| JP | 2000-181120 | 6/2000 |
| JP | 2000-284537 | 10/2000 |
| JP | 2001-272820 | 10/2001 |
| JP | 2002-023424 | 1/2002 |
| JP | 2002-304006 | 10/2002 |
| JP | 2003-156876 | 5/2003 |
| JP | 2003-156880 | 5/2003 |
| JP | 2003-337444 | 11/2003 |

OTHER PUBLICATIONS

U.S. Appl. No. 11/931,590, filed Oct. 31, 2007, Hasegawa, et al.
U.S. Appl. No. 11/956,378, filed Dec. 14, 2007, Shu, et al.
U.S. Appl. No. 11/950,114, filed Dec. 4, 2007, Shitara, et al.
U.S. Appl. No. 12/042,538, filed Mar. 5, 2008, Hasegawa.
U.S. Appl. No. 12/208,801, filed Sep. 11, 2008, Ogawa, et al.

* cited by examiner

FULL COLOR TONER, AND ITS USE IN ELECTROPHOTOGRAPHY METHODS AND APPARATUS

BACKGROUND OF THE INVENTION

1. Field of the Invention

The present invention relates to a full color toner for use in developing electrostatic images formed by electrophotography, electrostatic recording, electrostatic printing, etc., a developer containing the full color toner and a carrier, a fixing method of fixing full color toner images on a recording medium such as paper, a container containing the full color toner, a process cartridge containing the full color toner or the developer, and an image forming apparatus to which the container is provided.

2. Discussion of the Background

Image forming methods for use in electrophotography typically include the following processes:

(1) Forming a latent electrostatic image on an image bearing member formed of, for example, a photoconductive material;

(2) Attaching charged toner particles to the latent electrostatic image to form a visualized toner image;

(3) Transferring the visualized toner image to a recording material such as paper; and (4) Fixing the visualized toner image on the recording material before discharging the recording material outside;

Recently, the technology for use in photocopiers and printers using electrophotography has been rapidly extending from monochrome photocopying or printing to color photocopying or printing. Therefore the full color photocopier and printer market is expanding.

In color image forming based on full color electrophotography, all colors are typically reproduced by overlapping the layers of the three primary color toners, i.e., yellow, magenta and cyan toner, or of four color toners including the three primary color toners and black toner. To obtain a vivid and clear full color image having a good reproducibility, it is necessary to reduce light scattering by smoothing the surface of a fixed toner image to some degree. Because of this, typical full color photocopiers, etc. produce images having a gloss in the medium to high range, i.e., 10 to 50% in most cases.

As a method of fixing a dry toner image on a recording medium, a contact heating fixing method in which a roller or a belt having a smooth surface is heated to fix toner upon application of heat and pressure is normally adopted in many cases. This method is thermally efficient and fixes toner at a high speed, thereby providing gloss and transparency to color toner. Contrary to this advantage, offset phenomenon, in which part of a toner image attaches to the surface of a fixing roller and transfers to another image, occurs because the surface of the heated fixing roller is press-contacted with melted toner before detachment.

To prevent this offset phenomenon, a countermeasure has been adopted in which the surface of a fixing roller is formed of a material having a good releasability such as silicone rubber and fluorine containing resin and further a releasing oil such as silicone oil is applied to the surface of the fixing roller. Although this countermeasure is extremely effective to prevent toner offset, an additional device to supply the release oil is required, thereby increasing the size of the fixing device and cost. Therefore, this is not suitable in terms of reduction in size as a whole. Therefore, as for a monochrome toner, another method is-instead adopted in which no or a little amount of release oil is applied to a fixing roller (hereinafter referred to as an oilless method). In such an oilless method, viscosity and elasticity of the melted toner are increased by adjusting molecular weight distribution of a binder resin to prevent internal rupture of the melted toner and further a release agent such as wax is contained in the toner.

However, as mentioned above, in the case of a color toner, it is necessary to smooth the surface of an unfixed image to improve the color reproduction. Therefore, it is inevitable to reduce the viscosity and elasticity of a toner during melting. That is, relative to the case of a monochrome toner having a relatively low gloss, a color toner tends to offset so that it is difficult to adopt the oilless method mentioned above for a fixing device. In addition, when a release agent is contained in a toner, the attachment property of the toner is strengthened. As a result, the transferability of the toner to a transfer medium deteriorates. Further, this causes the problem that the release agent contained in the toner contaminates a friction charging member such as a carrier and reduces the chargeability of the friction charging member, resulting in deterioration of the durability of the friction charging member.

Typically binder resins such as polyester resins and epoxy resins, with which it is easy to obtain gloss with a low molecular weight, have been used in color toner. However, these resins contain a hydrophilic radical, which leads to a drawback in that the amount of charge therein greatly varies due to humidity. Further, there is a tendency that toner has recently been reduced in size to obtain quality images. However, polyester resins and epoxy resins have a drawback in that, polyester resins and epoxy resins are inferior to styrene resins, which have been used as a binder resin for use in monochrome toner, in terms of pulverization property.

Under these circumstances, unexamined published Japanese Patent Application No. (hereinafter referred to as JOP) H08-220808 describes a toner in which a combination of a linear type polyester resin having a softening point of from 90 to 120° C. and carnauba wax are used. JOP H09-106105 describes a toner formed of a resin and a wax which are compatible to each other and have a different softening point. JOP H09-304964 describes a toner in which the melting viscosity of each of a polyester resin and wax is regulated. JOP H10-293425 describes a toner containing a polyester resin having a softening point of from 90 to 120° C., rice wax, carnauba wax and silicone oil. JOP H05-61242 describes a polymerized toner containing wax therein. However, these toners fail to simultaneously and satisfactorily achieve anti-offset property, durability, stability in charging against moisture, and pulverization property when a fixing method in which no or even an extremely little amount of oil is applied is used.

Containing an ester wax as wax is also proposed to obtain a wide range of fixing temperature. JOP 2003-156876 describes a non-magnetic single-component developer including a polyester resin and an ester wax having an endothermic peak of 50 to 90° C. by DSC. Thereby, the developer has an excellent anti-offset property. But, since the ester wax and the polyester resin do not have good compatibility with each other, the ester wax and the polyester resin tend to have a phase separation so that the ester wax is released during developing, resulting in occurrence of carrier spent and filming. Therefore, durability of the developer is not good.

JOP 2000-181120 describes a developer including a polyester resin and an ester wax having an endothermic peak of 70 to 90° C. by DSC. Similarly, the developer does not improve the durability.

JOP 2002-23424 describes a color toner which contains an ester wax, a polyester resin, and a hybrid resin having a polyester and vinyl group based copolymer unit, and which has a molecular weight distribution parameter Mw/Mn by GPC not less than 100. Although the compatibility between the ester wax and polyester resin is improved by containing the hybrid resin, gloss property is not sufficient because Mw/Mn is not less than 100. Therefore, there is turbidity in color characteristics of the color toner and thus a good color saturation is not obtained.

Japanese Patent No. 3210174 describes a multi-functional polyester compound but a vinyl group based copolymer is used as a main binder resin so that its compatibility to the polyester resin is not improved.

JOP 2003-156880 describes a color toner containing a polyester resin and an olefin wax which has a molecular weight distribution parameter Mw/Mn not less than 50. Since the polyester resin has a good compatibility with the olefin wax, filming and spent can be improved by using the color toner. But the polyester resin is also compatible with the binder resin. Therefore, the release effect of the wax during fixing is insufficient. As a result, the molecular weight distribution parameter Mw/Mn is necessary to be not less than 50 to improve anti-hot-offset property. Consequently, sufficient gloss is not obtained again by using the color toner. In addition, there is turbidity in color characteristics of the color toner and thus a good color saturation is not obtained.

To solve these problems, there are many proposals in which hybrid resins are contained in a toner.

JOP 2002-23424 describes a mixture of a polyester or a styreneacryl resin and a hybrid resin. JOP 2001-272820 describes a mixture of two different hybrid resins. By these technologies, low temperature fixing property and anti-offset property can be improved. However, deterioration of gloss of color images and color reproducibility caused by containing a hybrid resin is not improved. These oilless fixing full color toner do not provide a combination of sufficient low temperature fixing property, good anti-hot-offset property, good gloss property, good color saturation and good durability without filming.

Further, especially a toner containing a wax tends to attach to each other and form agglomerated particles at a portion where stirring is performed in the developing portion. Especially in the case of a color toner, since color images are required to have a good gloss property, polyesters contained therein tend to have a low molecular weight. Thus, color toners further easily tend to form agglomerated particles in comparison with a toner dedicatedly for use in monochrome images. Further, since it is often that toner is actually stored in an environment in which the temperature is not less than 30° C. in actual photocopiers or printers, toner containing a wax more easily flocculates.

As for a two-component developer system, toner particles attach to each other and flocculate together by compressive contact between carriers while stirring the developer. In a one-component developer system, toner tends to flocculate together by pressure and friction heat when the toner is regulated to form a thin layer on a developing roller. Further, in both of a two-component developer system and a one-component system, heat generated by abrasion of axis of developer stirring blades and a screw causes the toner to be half melted and form agglomerated particles.

In the case of a two-component developer system, such toner agglomerated particles are developed or attached to an image portion, resulting in a large and thick dot thereon. When an image is transferred to a recording material, such agglomerated particles function as a spacer so that the corresponding portion in the image may white out.

In the case of a one-component developer system, such toner agglomerated particles sneak into a gap between a developing roller and a thin-layer forming blade, resulting in an abnormal image having a white streak.

Such an abnormal image tends to stand out in color in comparison with monochrome. In a situation in which quality images having a fine graduation property, a fine color reproducibility and a high definition are wanted, these abnormal images caused by agglomerated toner particles become a problem. Japanese Patents Nos. 3142297, 3073743, 3065073 and 3065032 describe a color toner formed of a linear polyester and a non-linear polyester. Thereby, fixing property and stability in charging of the color toner can be improved but improvement on agglomeration property thereof is not described.

JOP 2002-304006 describes a toner containing a polyester resin and a hybrid resin. The low temperature fixability, anti-hot-offset property and pulverization vulnerability are sufficiently improved by the toner. However, there is no description about gloss property, color reproducibility, and improvement on agglomeration property. A color toner having a sufficient low temperature fixing property and a sufficient anti-hot-offset property with improvement on gloss property, color reproducibility and agglomeration property has not been obtained.

SUMMARY OF THE INVENTION

Because of these reasons, the inventors of the present invention recognize a need exists for a full color toner which simultaneously has a good property on gloss, color reproducibility, anti-hot offset, and low temperature fixability without damaging agglomeration property.

Accordingly, an object of the present invention is to provide a full color toner which has a good durability and pulverization property to obtain quality images having a suitable and uniform gloss and good color saturation, which can sufficiently prevent offset even for a method in which no or an extremely small amount of release oil is applied to a fixing roller, and which does not cause toner agglomeration, wax spent, and filming even when the toner contains wax.

Further objects of the present invention are to provide a developer containing the full color toner, a fixing method and a fixing device which fix toner images developed by the full color toner or the developer, a process cartridge holding the full color toner or the developer, an image forming apparatus to which the process cartridge is provided, and an image forming method.

Briefly these objects and other objects of the present invention as hereinafter described will become more readily apparent and can be attained by a full color toner containing a binder resin, a release agent, and a colorant. The binder resin contains a polyester resin, and a hybrid resin containing one or more vinyl group polymer units, and one or more polyester units. In addition, the content A of the hybrid resin and the content B of the release agent satisfy the following relationship 1: $B/2 \leqq A \leqq 3B$ (relationship 1).

The present invention further provides an image forming method using the toner, a fixing device, process cartridge or image forming apparatus containing the toner, and a developer comprising the toner and a carrier.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
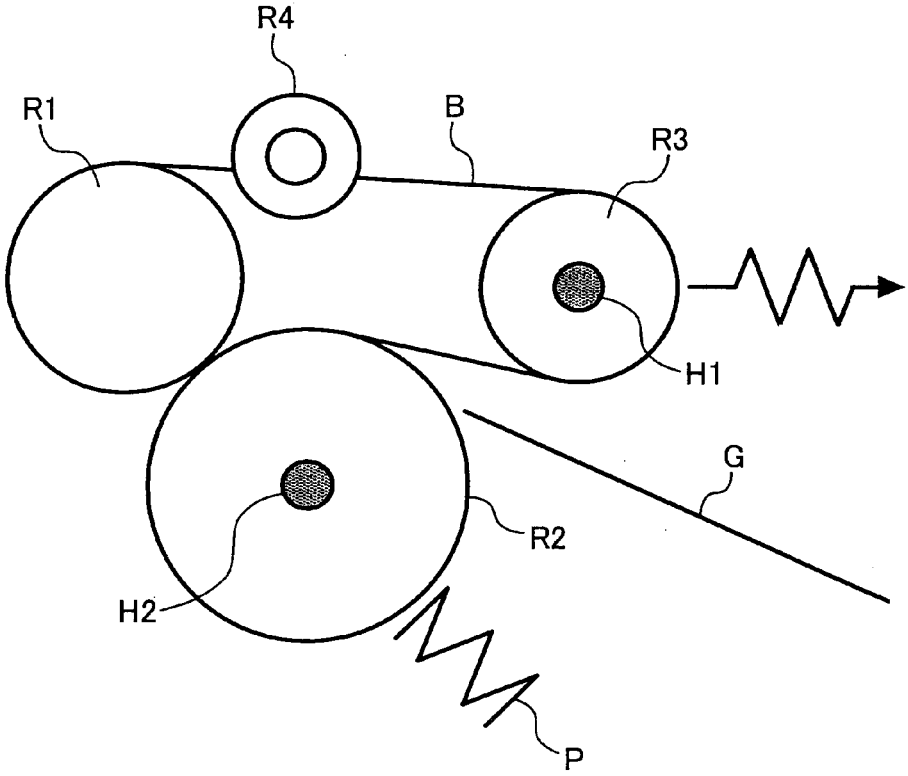
FIG. 1 is a schematic diagram illustrating an example of the fixing mechanism using a fixing belt for use in the fixing method of the present invention.

The present invention will be described below in detail with reference to several embodiments and accompanying drawings.

The full color toner of the present invention for use in image formation containing a polyester resin as a binder resin, a release agent, and a colorant further has a hybrid resin component containing one or more vinyl group polymer units and one or more polyester units. In the full color toner of the present invention, the content A of the hybrid resin and the content B of the release agent satisfy the following relationship (1): $B/2 \leqq A \leqq 3B$.

It is preferred that, in the full color toner mentioned above, the content B of the release agent is from 3.5 to 10 weight % based on a weight of the toner.

It is still further preferred that, in the full color toner mentioned above, the polyester resin contains a linear polyester resin and a non-linear polyester resin.

It is still further preferred that, in the full color toner mentioned above, the softening point of the non-linear polyester resin is C, the softening point of the linear polyester resin is D and the softening point of the hybrid resin is E, the following relationships 2 are satisfied:

$$C>E>D,$$

$$5 \leqq C-D \leqq 25, \text{ and}$$

$$C \leqq 130^\circ\ C. \qquad \text{(relationships 2).}$$

It is still further preferred that, in the full color toner mentioned above, the acid value of the non-linear polyester resin is F, the acid value of the linear polyester resin is G and the acid value of the hybrid resin is H, the following relationships 3 are satisfied: H>F and H>G (relationship 3).

It is still further preferred that, in the full color toner mentioned above, the release agent contains at least one of carnauba wax, montan wax, and oxidized rice wax.

It is still further preferred that, in the full color toner mentioned above, the mixture of a material monomer of a condensation polymerization resin and a material monomer of an addition polymerization resin is used to obtain the hybrid resin by performing at least one of simultaneous reactions of condensation-polymerization and addition polymerization of the mixture in the same reaction container and independent reactions thereof.

It is still further preferred that, in the full color toner mentioned above, the acid value of the hybrid resin is from 15 to 70 mg[KOH]/g.

It is still further preferred that the full color toner mentioned above contains a trivalent or higher salicylic acid metal compound.

It is still further preferred that, in the full color toner mentioned above, the toner has a volume average particle diameter of from 2.5 to 7 μm.

It is still further preferred that, in the full color toner mentioned above, the content of the colorant in the toner is not less than 7 weight % based on a weight of the toner.

As another aspect of the present invention, a fixing method is provided which includes fixing a full color toner image on a recording material upon application of heat and pressure by a fixed heater, a heating material having one of an endless belt form and a belt form having an end which is located opposing the fixed heater and heated thereby, and a pressing member configured to press the recording material against the heating material. In addition, the full color toner contains a binder resin, a release agent, and a colorant. The binder resin contains a polyester resin, and a hybrid resin containing one or more vinyl group polymer units, and one or more polyester units. In addition, the content A of the hybrid resin and the content B of the release agent satisfy the following relationship 1: $B/2 \leqq A \leqq 3B$ (relationship 1).

As another aspect of the present invention, a fixing device is provided which contains a fixed heater, a heating material having one of an endless belt form and a belt form having an end which is located opposing the fixed heater and heated thereby, and a pressing member configured to press a recording material against the heating material to fix a full color toner image on the recording material together with the heating material. The full color toner contains a binder resin, a release agent, and a colorant. The binder resin contains a polyester resin, and a hybrid resin containing one or more vinyl group polymer units, and one or more polyester units. In addition, the content A of the hybrid resin and the content B of the release agent satisfy the following relationship 1: $B/2 \leqq A \leqq 3B$ (relationship 1).

As another aspect of the present invention, a two-component developer is provided which contains a carrier, and a full color toner containing a binder resin, a release agent and, a colorant. The binder resin contains a polyester resin, and a hybrid resin containing one or more vinyl group polymer units, and one or more polyester units. In addition, the content A of the hybrid resin and the content B of the release agent satisfy the following relationship 1: $B/2 \leqq A \leqq 3B$ (relationship 1).

As another aspect of the present invention, a process cartridge is provided which contains an image bearing member, a developing device holding a full color toner or a developer containing the full color toner and a carrier, and optionally at least one of a charging device and a cleaning device. The full color toner contains a binder resin, a release agent, and a colorant. The binder resin contains a polyester resin, and a hybrid resin containing one or more vinyl group polymer units, and one or more polyester units. In addition, the content A of the hybrid resin and the content B of the release agent satisfy the following relationship 1: $B/2 \leqq A \leqq 3B$ (relationship 1).

The full color toner of the present invention has a good fixing property, a good gloss property, and good color reproducibility with uniform gloss. Further the full color toner tends not to flocculate. By the hybrid resin component having one or more vinyl group polymer units and one or more polyester units, the compatibility of the polyester resin forming the binder resin and the release agent can be improved. This is thought to be because the solubility of the release agent and the vinyl group based polymer unit of the hybrid resin component is high and the solubility of the polyester resin forming the binder resin and the polyester based unit of the hybrid resin component is high.

Further, when the contents A and B satisfy the following relationship: $B/2 \leqq A \leqq 3B$, the hybrid resin component can function as a dispersant for the release agent for the polyester resin mentioned above. When the relationship is satisfied, the release agent can be finely-dispersed in the polyester resin functioning as binder resin. In addition, the release agent has a high viscosity. Therefore, when its raw material is powder-mixed during preparation of a toner, carbon black, functioning as a colorant, dyes, or master batch dyes tend to more easily attach to the release agent than to the binder resin, meaning that such dyes and colorant tend to be dispersed accompanying the release agent. That is, the dispersability of the release agent greatly contributes to the dispersability of the dyes. Further, since the vinyl group based polymer unit of the hybrid resin component is hydrophobic, the unit can weaken the moisture absorption property of the toner, which leads to good environmental stability with regard to charging of the toner. Additionally, because the moisture absorption property of the toner is weakened, deterioration of anti-agglomeration property of the toner can be prevented. Therefore, the toner obtained by the present invention does not impair the gloss property because the release agent has a good dispersability. Further, toner agglomeration stemming from poor dispersion of the release agent in the binder resin does not occur. Furthermore, since the dispersion property of the dyes is also improved, a toner having good color reproducibility can be obtained.

With regard to toner agglomeration, color toner tends to flocculate in comparison with monochrome black toner because color toner has a lower softening point than monochrome black toner. But, when the content A of the hybrid resin and the content B of the release agent satisfy the relationship mentioned above, the toner does not flocculate and has a stable chargeability even when the toner is stored in a photocopier in an high temperature environment, i.e., about not less than 30° C., or in a high humidity environment, i.e., not less than 70%. When the content A is less than a half of the content B, meaning that the amount of the hybrid resin component is too small, the dispersion of the release agent and the colorant is not sufficient so that the gloss property for color images tends to deteriorate and the toner tends to flocculate. When the content A is greater than three times the content B, meaning that the amount of the hybrid resin component is too large, the hybrid resin and the polyester forming the binder rein tend to undergo phase separation. In addition, since the content of the vinyl group based polymer unit in the hybrid resin component increases, the gloss property for color images tends to deteriorate, resulting in non-uniform gloss. Also the low temperature fixability tends to deteriorate. With regard to the contents A and B, the following relationship is preferred: $B \leqq A \leqq 2B$. When the dispersion particle diameter of the release agent in the toner is from 0.1 to 1.0 μm and the dispersion particle diameter of the colorant is not greater than 0.5 μm, the agglomeration property of the toner obtained does not deteriorate and color images having a good color reproducibility can be obtained by using the toner without reducing the gloss level. The dispersion particle diameters of the release agent and the colorant are more preferred to be from 0.1 to 0.5 μm and not greater than 0.3 μm, respectively.

When the content of the release agent is from 3.5 to 10 weight %, the fixing property of the toner ameliorates. When the dispersion particle diameter is small, i.e., from 0.1 to 0.5 μm, and the content of the release agent is too small (not greater than 3.5 weight %), the anti-hot offset property is not sufficient. When the content of the release agent is too large (not less than 10 weight %), the anti-agglomeration property of the toner tends to deteriorate especially in the case of a toner having a small particle size. The content of the release agent is more preferably from 4.0 to 7.0 weight %.

The preferred content ratio (HB/PE) of the hybrid resin (HB) and the binder resin polyester resin (PE) is from 5 to 30%, and more preferably from 10 to 20 weight %.

When the polyester resin forming the binder resin is formed of a linear polyester containing no tetrahydrofuran (THF) insoluble component and a non-linear polyester containing a tetrahydrofuran (THF) insoluble component from 1 to 15%, preferably from 1 to 10%, and more preferably from 2 to 8% based on the resin component, a wide (r) range of fixing temperature can be secured. The ratio (LP/NLP) of the linear polyester (LP) and the non-linear polyester (NLP) is from 20/80 to 80/20, preferably from 30/70 to 30/70, and more preferably from 40/60 to 60/40. When the polyester resin contains a linear polyester and a non-linear polyester, the linear polyester improves the low temperature fixing property and the non-linear polyester improves the anti-hot-offset property. However, not to impair the gloss property, it is necessary for a release agent to have a good dispersability. The dispersability of a release agent can be improved by controlling mechanical shearing and dispersion force during mixing and kneading. However, it is practically difficult to separately control the shearing and the dispersion. Actually when dispersion property is improved, resultantly shearing also proceeds. Thereby, the molecular weight of the polyester tends to decrease so that it is impossible to improve the anti-hot offset property by the non-linear polyester. However, in the present invention, since a hybrid resin is contained, the dispersion property of a release agent and a colorant is improved. Therefore, the necessity of controlling the mechanical energy against dispersion is low and only shearing control is required. Consequently, desired shearing can be performed without impairing the gloss property. As a result, the linear polyester can improve the low temperature fixability and the non-linear polyester can improve the anti-hot offset property. When the relationships are satisfied: $C>E>D$, $5 \leqq C-D<25$, $C \leqq 130°$ C., (in the relationship, C, D and E represent the softening point of the non-linear polyester mentioned above, the softening point of the linear polyester, and the softening point of the hybrid resin, respectively), compatibility and dispersabiltiy can be further improved and high gloss property, good color reproducibility and wide range of fixing temperature can be secured.

When the following relationship is satisfied: $5>C-D$, the improvement effect with regard to the width of the fixing temperature is small. When the following relationship is satisfied: $C-D>25$, the resins tend to have phase separation. When C is greater than 130° C., that condition tends to have an adverse impact on the allowable lowest fixing temperature.

When the following relationships are satisfied: $H>F$ and $H>G$, (in the relationships, F, G and H represent the acid value of the non-linear polyester mentioned above, the acid value of the linear polyester, and the acid value of the hybrid resin, respectively), the dispersion property among the materials are improved. This is because the vinyl group based polymer unit of the hybrid resin is dispersed in a toner while encapsulating a release agent so that hydorophobicity of the vinyl group based polymer unit is heightened and the hybrid resin tends to be phase-separated with the polyester resin. When the following relationships are satisfied: $H>F$ and $H>G$, the acid portion of the hybrid resin is compatible with the acid portion of the polyester, resulting in improvement on dispersion property among the materials. Any known release agent can be used as the release agent in the present invention. Especially when carnauba wax which is subject to a treatment of eliminating free aliphatic acid therefrom, montan wax and oxidized rice wax are used alone or in combination, the dispersion effect of the hybrid resin is heightened. It is preferred to use fine-crystalline carnauba wax having an acid value not greater than 5 and a particle diameter not greater than 1 μm when the carnauba wax is dispersed in a toner binder. The montan wax mentioned above represents montan based waxes refined from a mineral and it is preferred to use a fine-crystalline montan wax like carnauba wax which has an acid value of from 5 to 14. With regard to oxidized rice wax, typically air oxidized rice bran wax can be used and it is preferred to use a rice wax having an acid value of from 10 to 30. Specific examples of other known release agents include solid form silicone varnishes, higher fatty acid higher polyhydric alcohols, montan based ester waxes, and low molecular weight polypropylene waxes. These can be also used in combination. It is preferred that the release agent, before being dispersed in a toner binder has a volume average particle diameter of from 10 to 800 μm. When the volume average particle diameter is too small, the dispersion particle diameter of the release agent tends to be so small that the release effect thereof is insufficient, resulting in occurrence of offset. When the volume average particle diameter is too large, the dispersion particle diameter of the release agent tends to be so large that the precipitation of the release agent on the surface of a toner is too large, resulting in deterioration of fluidity and fixation in a developing device. To measure the particle diameter of a release agent, a laser scattering particle size distribution analyzer LA-920, manufactured by Horiba, Ltd., is preferably used.

Since the hybrid resin in the present invention is formed by chemically combining a condensation polymerization resin and an addition polymerization resin, it is preferred to perform polymerization using a compound which can react with monomers of both resins (hereinafter referred to as both reactive monomer compound). Specific examples of such both reactive monomer compounds include fumaric acid, acrylic acid, methacrylic acid, maleic acid and dimethyl fumaric acid.

The amount of the both reactive monomer compounds is from 1 to 25 parts by weight, and preferably from 2 to 10 parts by weight based on 100 parts by weight of a material monomer of an addition polymerization resin. When the amount thereof is too small, the dispersion of colorant and charge controlling agent deteriorates, which leads to deterioration of image quality such as fogging. When the amount thereof is too large, there is a drawback that the resin tends to gel.

To obtain the hybrid resins mentioned above, it is not necessary to perform or complete both reactions simultaneously but possible to independently complete both reactions by setting each reaction temperature and time.

For example, there is a condensation polymerization reaction method as follows: drop a mixture of an addition polymerization material monomer of a vinyl group based resin and a polymerization initiator in a mixture of a condensation polymerization material monomer of a polyester resin in a reaction container to complete polymerization reaction of the vinyl group based resin by radical reaction; and complete the condensation polymerization of polyesterization by raising the reaction temperature. In this method, it is possible to effectively disperse the two kinds of resins by proceeding in parallel with the two independent reactions in one reaction container. To effectively disperse the resins, it is possible to proceed sequentially and/or in parallel with the two independent reactions. The acid value of the hybrid resin is preferably from 15 to 70 mg KOH/g, more preferably from 20 to 50 mg KOH/g, and most preferably from 20 to 30 mg KOH/g. When the acid value thereof is from 15 to 70 mg KOH/g, the dispersion effect of the release agent is high and the low temperature fixing property and environment stability are good. This is thought to be because, by heightening the acid value, the compatibility between a paper and the resin is improved, which further improves the low temperature fixing property. When the acid value is too small, the release agent which is dispersed while being encapsulated in the hybrid resin is easily released from the polyester. When the acid value is too large, the impact of the moisture in the air increases, which causes the chargeability of the toner to be unstable.

In addition, when a trivalent or higher salicylic acid metal complex is contained, the metal complex contributes to the reaction to highly reactive portions of the resin and the wax, or the metal complex itself is, for example, coordinately linked with an easy coordinate portion of the resin and the wax to lightly form a cross-linkage structure, which leads to improvement on anti-hot offset property. When the valence of the center metal of the metal complex is less than 3, the metal complex does not have an effect on improvement of anti-hot-offset property because the linkage is two-dimensional.

In addition, the content of a salicylic acid metal compound is 0.05 to 10 parts by weight based on 100 parts by weight of a toner, the salicylic acid metal compound has an improvement effect on anti-hot offset property of the toner. When the content thereof is too small, the effect is not sufficient. When the content thereof is too large, the anti-hot offset property is further improved but the low temperature fixing property is insufficient. When the acid value of a hybrid resin is not less than 15 mgKOH/g, anti-hot offset property is good. This is thought to be because the acid radical portions or the acid portions of a hybrid resin serve as portions to easily react with the cross linkage portion with a salicylic acid metal complex.

In addition, when the volume average particle diameter (Dv) of a toner is from 2.5 to 7.0 μm, its fine-line reproducibility is excellent.

A COULTER COUNTER for use in measuring the particle size distribution in the present invention is schematically described. The volume average particle diameter (Dv) and the number % of the particles having a particle diameter not greater than 5 μm are measured by COULTER COUNTER TAII manufactured by Beckman Coulter, Inc. connected to an interface manufactured by Nikkaki Bios Co., Ltd., and PC9801 personal computer manufactured by NEC Corporation which output number distribution and volume distribution. The electrolytic aqueous solution is an about 1% NaCl aqueous solution prepared by using primary NaCl. The measuring method is:

Add 0.1 to 5 ml of a surface active agent, preferably a salt of an alkyl benzene sulfonate, as a dispersant to 50 to 100 ml of the electrolytic aqueous solution; add 1 to 10 mg of a measuring sample to the electrolytic aqueous solution; the electrolytic aqueous solution is subject to a dispersion treatment with a supersonic disperser for one minute; pour 100 to 200 ml of the electrolytic aqueous solution in another beaker; add the sample dispersion liquid mentioned above to the another beaker to have a predetermined density; Measure the particle size distribution of 30,000 particles having a particle diameter of from 2 to 40 μm based on the number of the particles by the COULTER COUNTER TAII mentioned above with an aperture of 100 μm; calculate the volume distribution and the number distribution of particles having a particle diameter of from 2 to 40 μm; and obtain the volume average particle diameter based on the weight obtained by the volume distribution.

Since the color toner of the present invention does not release wax, the fluidity of the color toner does not deteriorate due to containment of the wax. The toner container filled with the toner of the present invention has a good property of replenishing the toner.

In addition, since carriers are not contaminated by wax, a two-component developer having a good durability can be obtained.

Since the toner of the present invention does not cause non-uniform gloss and has a wide range of fixing temperature, a contact thermal fixing method which has a smooth fixing surface and a good release property is adopted as the fixing method. In such a method, no or an extremely little amount of release oil is applied. Specifically, in a preferred fixing method, a roller and a belt are used, the surface of which is formed of a material such as a fluorine resin/rubber and a silicone resin/rubber having a low surface energy. Further, it is preferred that the form of a fixing nip is concaved to the side of a fixing roller or a fixing belt to avoid offset and enwinding of a recording material. This can be because the physical releasability is improved by the transformation of the fixing roller or the fixing belt, and the recording material is discharged from the fixing roller or the fixing belt at a large detachment angle. Therefore, it is preferred to use a fixing roller, a fixing belt or a fixing belt supporting roller formed of an elastic body, the hardness of which is designed to be lower than that of a pressing roller.

FIG. 1 is a schematic diagram illustrating an example of the fixing mechanism using a fixing belt for use in the fixing method of the present invention. In FIG. 1, a recording medium carrying transferred toner thereon is transferred along a guide (G) and through between a fixing belt (B), which is heated and driven, and a pressing roller (R2). Thereby, the toner is melted and attached to the recording medium so that the toner image can be fixed. This fixing device is referred to as a surf fixing device in which the fixing belt (B) is rotated to fix an image. The fixing belt (B) is suspended over a fixing roller (R1) and a heating roller (R3) having a heat source (H1) therein and also serving as a tension roller constantly pulled toward outside. The fixing belt (B) forms a fixing nip area having a concave form together with a pressing roller (R2) having a heat source (H2) which is constantly pressed toward the side to the fixing belt (B) by a pressing spring (P). The driving rotation speed is controlled such that the speed of the fixing belt (B) is the same as the speed of the recording medium at the fixing nip area where the pressing roller (r2) and the fixing belt (B) contact with each other. The pressing roller (R2) is a roller having a rubber elastic layer having a good releasability formed of, for example, silicone rubber and rotates counterclockwise while in contact in the fixing nip area mentioned above under the contact pressure of, for example, 4 to 10 kg in total. Also present is cleaning roller (R4).

Figure 2:
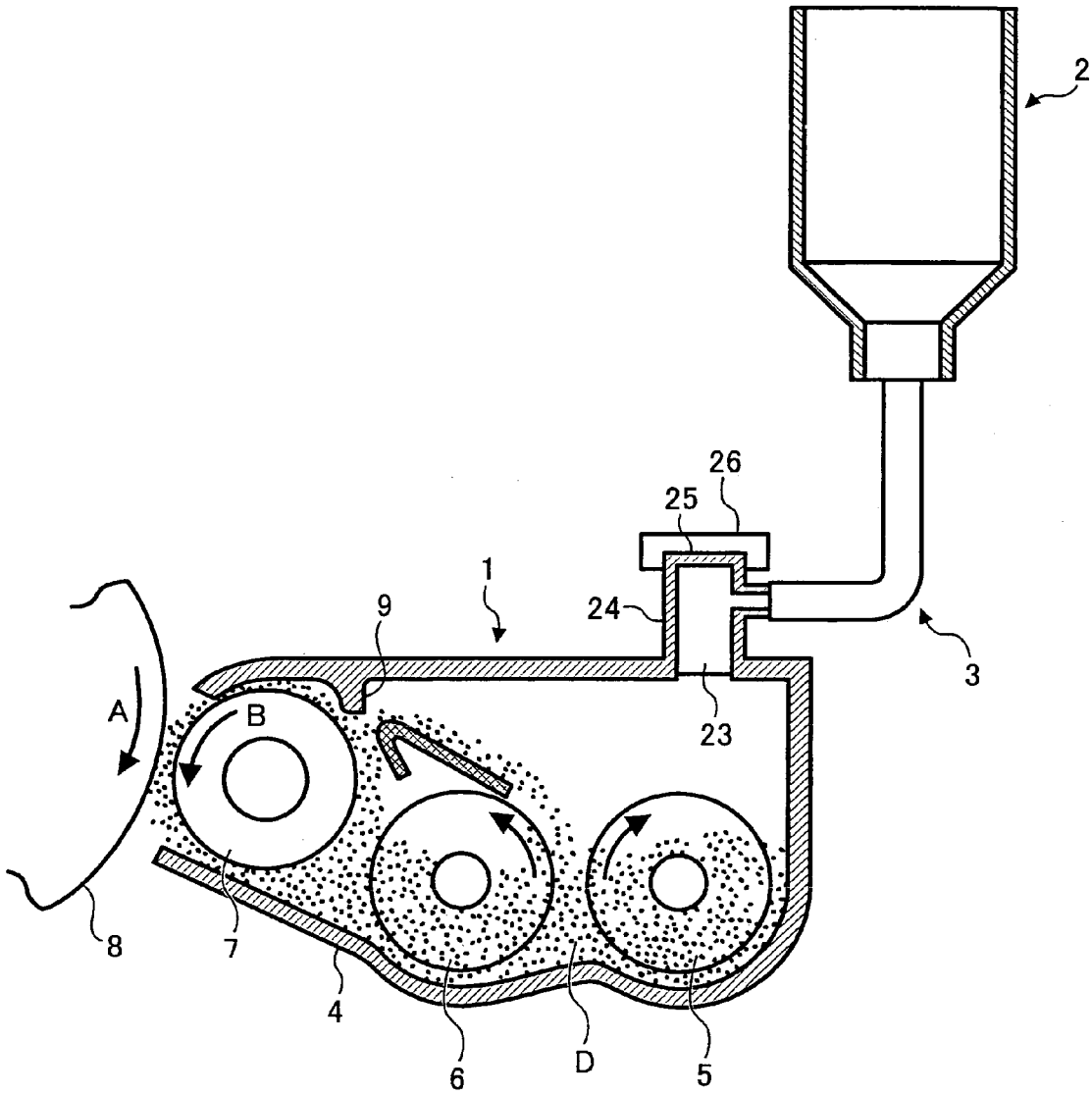
FIG. 2 is a diagram illustrating an example of the image forming apparatus to which the process cartridge of the present invention containing a developing device is provided.

Further, the image forming apparatus of the present invention is described with reference to FIG. 2. FIG. 2 is a diagram illustrating an example of an essential portion of an image forming apparatus including a container filled with the toner of the present invention. A case in which a two-component developer is used is described below. FIG. 2 is a partial cross section illustrating a development portion (1) attached in the body of an image forming apparatus, a toner container (2) filled with the toner of the present invention which is replenished to the development portion (1), and a toner transferring device (3) connecting the development portion (1) and the toner container (2). In FIG. 2, the development portion (1) has a development housing (4) filled with a two-component developer (D) formed by mixing the toner of the present invention and a carrier for use in electrophotography, a first stirring screw (5) and a second stirring screw (6) which stir and mix the developer (D), and a developing roller (7), which is located opposing a photoreceptor (8) functioning as a latent image bearing member. The photoreceptor (8) functioning as a latent image bearing member rotates in the direction indicated by an arrow A and a latent electrostatic image is formed on the surface thereof. In FIG. 2, (26) represents a cap which is fitted on a connecting member (24) with or without a filter (25) therebetween. A numeral (23) represents a toner replenishing portion, and a toner supplying controlling device can be provided if necessary. Around the photoreceptor (8), a charging member (not shown), an irradiator (not shown), a transfer device (not shown), a discharging member (not shown), a cleaning device (not shown) and any other known units (not shown) are provided. When the first and the second screws (5) and (6) are rotated, the developer (D) and replenished toner in the development housing (4) are stirred and mixed. The toner and the carrier are reversely friction-charged to each other. The developer (D) is supplied to the circumference surface of the developing roller (7) which is rotary driven in the direction indicated by an arrow B. The developer (D) is transferred along the rotation direction. Then the amount of the transferred developer (D) is regulated by a doctor blade (9) and thereafter the developer (D) is transferred to the development area formed by the photoreceptor (8) and the developing roller (D). The toner in the developer (D) is electrostatically transferred to the latent electrostatic image on the surface of the photoreceptor (8) to visualize the latent electrostatic image.

Polyester resins for use in the present invention are obtained by a condensation polymerization reaction between a polyhydric carboxylic acid component and a polyhydric alcohol component. The polyhydric carboxylic acid component is formed of one or more dicarboxylic acids and, if necessary, tricarboxylic acids. Specific examples of dicarboxylic acids include (1) aliphatic dicarboxylic acids having 2 to 20 carbon atoms such as maleic acid, fumaric acid, succinic acid, adipic acid, sebacic acid, malonic acid, azelaic acid, mesaconic acid, citraconic acid, and glutaconic acid, (2) cyclo dicarboxylic acids having 8 to 20 carbon atoms such as cyclohexane dicarboxylic acid and methyl medic acid, (3) aromatic dicarboxylic acids having 8 to 20 carbon atoms such as phthalic acid, isophthalic acid, terephthalic acid, toluene dicarboxylic acid and naphthalene dicarboxylic acid, (4) alkyl or alkenyl succinic acid having 4 to 35 hydrocarbon groups in its side-chain such as isododecenyl succinic acid and n-dodecenyl succinic acid, and anhydrides or lower alkyl (e.g., metyl and butyl) esters of these dicarboxylic acid. Among these, (1), (3), (4) and anhydrides or lower alkyl esters of these dicarboxylic acid are preferred. Maleic (anhydride) acid, fumaric acid, isophthalic acid, terephthalic acid, dimethyl terephthalate, and n-dodecenyl succinic (anhydride) acid are more preferred. Specific examples of tri- or higher polyhydric carboxylic acids include (1) aliphatic polycarboxylic acids having 7 to 20 carbon atoms such as 1,2,4-butane tricarboxylic acid, 1,2,5-hexane tricarboxylic acid, 1,3-dicarboxyl-2-methyl-2-methylene carboxypropane, tetra (methylene carboxyl)methane, and 7,8-octantetra carboxylic acid, (2) cylcoaliphatic polycarboxylic acids having 9 to 20 carbon atoms such as 1,2,4-cyclohexane tricarboxyl acid, (3) aromatic polyhydric carboxylic acid having 9 to 20 carbon atoms such as 1,2,4-benzene tricarboxylic acid, 1,2,5-benzene tricarboxylic acid, 2,5,7-naphthalene tricarboxylic acid, 1,2,4-naphthalene tricarboxylic acid, and pyromellitic acid, benzophenon tetracarboxylic acid, and their anhydrides and lower alkyl (e.g., methyl and butyl) esters. When a tri- or higher polyhydric carboxylic acid is used, it is preferred to use (3) and their anhydrides or lower alkyl esters. However, its quantity consumed is limited to a small quantity because gloss and transparency tends to deteriorate by using such a carboxylic acid. In addition, specific examples of the polyhydric alcohol components include (1) alkylene glycols having 2 to 12 carbon atoms such as ethylene glycol, 1,2-propylene glycol, 1,3-propylene glycol, 1,4-butane diol, neopentyl glycol, 1,4-butane dol, 1,5-pentane diol, and 1,6-hexane diol, (2) alkylene ether glycols such as diethylene glycol, triethylene glycol, dipropylene glycol, polyethylene glycol, polypropylene glycol, and polytetramethylene glycol, (3) cycloaliphatic diols having 6 to 30 carbon atoms such as 1,4-cyclohexane dimethanol, and hydrogenised bisphenol A, (4) bisphenols such as bisphenol A, bisphenol F, and bisphenol S, and (5) an adduct of bisphenols mentioned above with 2 to 8 moles of alkyleneoxide (e.g., EO, PO and butylene oxide). Among these, (1) and (5) are preferred, and (5) is more preferred. Among (5), an adduct of bisphenol A with 2 to 4 moles of EO and/or PO is especially preferred because such an adduct imparts a good offset property to a toner. Specific examples of such tri- or higher polyhydric alcohols include aliphatic polyhydric alcohols having 3 to 20 carbon atoms such as sorbitol, 1,2,3,6-hexane tetrol, 1,4-sorbitan, pentaerythritol, di-pentaerythritol, tri-pentaerythritol, 1,2,4-butane triol, 1,2,5-pentantriol, glycerol, 2-methyl propane triol, 2-methyl-1,2,4-butane triol, trimethylol ethane, and trimethylol propane, (2) aromatic polyhydric alcohols having 6 to 20 carbon atoms such as 1,3,5-trihydroxylmethyl benzene, and their adducts of alkylene oxide. When a tri- or higher polyhydric alcohol is used, (1) is preferred among these. Especially glycerol, trimethylol propane and pentaerythritol are preferred in terms of cost. However, the quantity consumed is limited to a small quantity because gloss and transparency tend to deteriorate by using glycerol, trimethylol propane and pentaerythritol.

Any pigments and dyes which can be used to obtain each color toner such as yellow toner, magenta toner, cyan toner and black toner can be used for colorants for use in the color toners of the present invention and are not limited to the following examples. Specific examples of yellow dyes include cadmium yellow, Mineral Fast Yellow, nickel titan yellow, Naples yellow, Naphthol Yellow S, HANSA yellow G, HANSA Yellow 10G, Benzidine Yellow GR, Quinoline Yellow Lake, Permanent Yellow NCG and Tartrazine Lake.

Specific examples of orange dyes include molybdenum orange, Permanent Orange GTR, Pyrazolone Orange, Vulcan Orange, Indanthrene Brilliant Orange RK, Benzidine Orange G, and Indanthrene Brilliant Orange GK.

Specific examples of red dyes include red iron oxide, cadmium red, Permanent Red 4R, Lithol Red, PYRAZOLONE Red, Watching Red Calcium salt, Lake Red D, Brilliant Carmine 6B, Eosin Lake, Rhodamine Lake B, Alizarine Lake, and Brilliant Carmine 3B.

Specific examples of violet dyes include Fast Violet B, and Methyl Violet Lake.

Specific examples of blue dyes include cobalt blue, alkali blue, Victoria Blue Lake, Phthalocyanine Blue, metal-free Phthalocyanine Blue, partially chlorinated Phthalocyanine Blue, Fast Sky Blue, and Indanthrene Blue BC.

Specific examples of green dyes include chrome green, chromium oxide, Pigment Green B and Malachite Green Lake.

Specific examples of black dyes include azine-based dyes such as carbon black, Oil Furnace Black, Channel Black, Lamp Black, acetylene Black, and aniline black, metal salt azo dyes, metal oxides, and composite metal oxides.

These colorants can be used alone or in combination.

The color toner of the present invention may include a charge controlling agent therein if necessary. Specific examples of such charge controlling agents include nigrosine, azine-based dyes including an alkyl group having 2 to 16 carbon atoms (described in JPP S42-1627), basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000), Lake dyes of the basic dyes, C. I. Solvent Black 8 (C. I. 26150), quaternary ammonium salts such as benzoyl methyl hexadecyl ammonium chloride and decyl trimethyl chloride, dialkyl tin compounds of, for example, dibutyl and dioctyl, dialkyl tin borate compounds, guanidine derivatives, vinyl-based polymers including an amino group, polyamine resins such as condensation polymers including an amino group, metal complexes of monoazo dyes described in examined published Japanese patent applications Nos. (hereinafter referred to as JPP) S41-20153, S43-27596, S44-6397, and S45-26478, metal complexes of Zn, Al, Co, Cr, Fe, etc., for salicylic acid, dialkyl salicylic acid, naphthoic acid, and dicarboxylic acid described in JPPs S55-42752 and S59-7385, sulfonated copper phthalocyanine dyes, organic boron salts, fluorine-containing quaternary ammonium salts, and calixarene-based compounds. For the color toners other than a black toner, it is natural to avoid using a charge controlling agent having a color impairing the desired color tone of the color toner. Therefore, it is preferred to use, for example, a metal salt of a white salicylic acid derivative.

With regard to the full color toner of the present invention, an additive such as inorganic particulates of, for example, silica, titan oxide, aluminum, silicon carbide, silicon nitride, and boron nitride, and a resin particulate, can be externally added to a mother toner particle to further improve transferability and durability of a toner. The transferability and durability of a toner are improved because the external additive cloaks a wax, which degrades transferability and durability of the toner, and the contact area is reduced when the surface of a toner is covered with the external additive. The surface of the inorganic particulate is preferred to be hydrophobized. It is thus preferred to use particulates of a metal oxide such as hydrophobized silica and hydrophobized titanium oxide.

As for the resin particulates, it is preferred to use particulates of polymethyl methacrylate and polystyrene prepared by soap free emulsification polymerization method having an average particle diameter of from 0.05 to 1 μm. Further, such inorganic particulates and resin particulates can be used alone or in combination. For example, when hydrophobized silica and hydrophobized titanium oxide are used in combination, a toner can have a stable chargeability against humidity by externally adding the titanium oxide in a larger amount than the hydrophobized silica.

When silica having a specific surface area of from 20 to 50 $m^2/g$ or resin particulates having a relatively large particle diameter in comparison with that of a typically used external additive, which is 1/100 to 1/8 as large as the particle diameter of a toner, is externally added to a toner in combination with the inorganic particulates mentioned above, durability of a toner can be improved. This is because, metal oxide particulates externally added to a toner tend to sink in a mother toner particle when the toner is mixed and stirred with a carrier in a developing device to be charged and served for development, but such an external additive having a larger particle diameter than that of the metal oxide particulates can restrain the metal oxide particulates from sinking in a mother toner particle.

The inorganic particulates and the resin particulates mentioned above can be also contained in, i.e., internally added to, a toner. Such internally added particulates can improve transferability and durability of a toner even its improvement effect is not as good as the case of externally added particulates. Further, anti-pulverization property of a toner can be improved by internally adding these particulates. When such particulates are internally and externally added to a toner, the internally added particulates restrain the externally added particulates from sinking in the toner so that the transferability of the toner is stably good and the durability can be improved.

Specific examples of the hydrophobizing agents include the following: dimethyl dichlorosilane, trimethyl chlorosilane, methyl trichlorosilane, allyl dimethyl dichlorosilane, allylphenyl dichlorosilane, benzildimethyl chlorosilane, bromomethyl dimethyl chlorosilane, α-chloroethyl trichlorosilane, p-chloroethyl trichlorosilane, chloromethyl dimethyl chlorosilane, chloromethyl trichlorosilane, p-chlorophenyl tricholosilane, 3-chloropropyl trichlorosilane, 3-chloropropyl trimethoxysilane, vinyltriethoxysilane, vinylmethoxysilane, vinyl-tris(β-methoxyethoxy)silane, γ-methacryloxy propyltrimethoxysilane, vinyltriacetoxysialne, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dibentyl-dichlorosilane, dihexyl-dichlorosilane, dioxyl-dichlorosilane, dinonyl-dichlorosilane, didecyl-dichlorosialne, didodecyl-dichlorosialne, dihexadecyl-dichlorosialne, (4-t-butylphenyl)-octyl-dichlorosialne, dioctyl-dichlorosialne, didecenyl-dichlorosialne, dinonenyl-dichlorosialne, di-2-ethylhexyl-dichlorosialne, di-3,3-dimethylbentyl-dichlorosialne, trihexyl-chlorosialne, trioctyl-chlorosialne, tridecyl-chlorosialne, dioctyl-methyl-chlorosialne, octyl-dimethyl-chlorosialne, (4-t-propylphenyl)-diethyl-chlorosialne, octyltrimethoxysilane, hexamethyldisilazane, hexaethyldisliazane, diethyltetramethyldislazane, hexaphenyldisilazane, and hexatolyldisilazne. Also, titanate-based coupling agents, and aluminum-based coupling agents can be used. In addition, as an external additive for use in improving cleanability, lubricants such as particulates of aliphatic metal salts and polyvinylidene fluoride can be used in combination with other additives.

When the color toner of the present invention is used as a component of a two-component developer, the color toner is mixed with carrier powder. Any known carrier can be used. Specific examples of such known carrier powder include iron powder, ferrite powder, magnetite powder, nickel powder, and glass beads. Also the surface of these carrier powders can be coated with a resin. Specific examples of such resins coated to cover the surface of these carrier powders include silicone-based resins, fluorine-based resins, and acrylic resins. Such a carrier preferably has a volume average particle diameter of from 25 to 200 μm. The ratio of the toner to a carrier is from about 1/99 to about 10/90 depending on their particle diameters.

With regard to the manufacturing method of the present invention, a toner manufacturing method can be adopted which has a process of mechanically mixing developer components including a binder resin, a main charge controlling agent, and dyes, a process of melting and kneading the resultant, a process of pulverizing the resultant, and a process of classifying the resultant. Powder obtained in the pulverization process or the classification process which fails to satisfy the condition of the product can be supplied back to the mechanical mixing process and the melting and kneading process. To improve dispersion property of a dye, subsequent to master batch treatment, the dye can be mixed with other raw materials and processed in the next process.

The powder (a by-product) which is not a particle used as product represents fine particles or coarse particles generated in the pulverization process or the following process, i.e., the classification process, performed after the melting and kneading process, which fail to have the predetermined particle diameter of a product. Such a by-product is preferred to be mixed with the raw material in the mixing process or the melting and kneading process with a ratio of the by-product to the raw material of from 1/99 to 50/50.

The mechanical mixing process in which developer components containing a binder resin, a main charge controlling agent, a dye, and a by-product, can be performed by a typical mixer having rotating blades under a normal condition and has no specific limit.

When the mixing process is complete, the mixture is set to be melted and kneaded in a kneading machine. As for melting and kneading machines, one-axis (single screw) or two-axis (twin screw) continuous kneading machines or batch type kneading machines using a roll mill can be used.

Any known method can be used as the method of manufacturing the toner of the present invention. In the pulverization method, batch-type double rolls, Bumbury's mixer, continuation-type two-axis extruders such as a KTK type two-axis extruder manufactured by Kobe Steel., Ltd., a TEM type two-axis extruder manufactured by Toshiba Machine Co., Ltd., a two-axis extruder manufactured by Asada Iron Works Co., Ltd., a PCM type two-axis extruder manufactured by Ikegai Ltd., and a KEX type two-axis extruder manufactured by Kurimoto Ltd., a continuation-type one axis kneader such as Co-Kneader manufactured by Coperion Buss can be preferably used as a device to mix and knead a toner.

The melted and kneaded mixture obtained is thereafter cooled down and pulverized. As to pulverization, the melted and kneaded mixture is coarsely-pulverized by, for example, a hammermill, ROTOPLEX, etc., and then finely-pulverized by a fine pulverizer using an air jet or a mechanical fine pulverizer. It is preferred to pulverize the mixture in such a manner that the pulverized mixture has an average particle diameter of from 3 to 15 μm. Further, the pulverized mixture is preferred to be adjusted by, for example, an air classifier, in a manner that the size of the adjusted particles is from 2.5 to 20 μm. Thereafter, external additives are attached to a mother toner particle. The external additives and the mother toner are mixed and stirred by a mixer, etc. While the external additives are pulverized, the surface of the mother toner is covered with the external additives. It is essential to firmly and uniformly attach external additives such as inorganic particulates and resin particulates to a mother toner in terms of durability.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts and %, unless otherwise specified.

EXAMPLES

Example 1

Synthesis of Linear Polyester Resin P(1)

(1) The following components were placed in a reacting container equipped with a condenser, a stirrer and a nitrogen introducing tube and reacted for 10 hours at 220° C. eliminating water generated under nitrogen air flow;

| | |
|---|---|
| Adduct of bisphenol A with 2 moles of EO | 400 parts |
| Adduct of bisphenol A with 2 moles of PO | 300 parts |
| Terephthalic acid | 280 parts |
| Fumaric acid | 80 parts |
| Dibutyl tin oxide (functioning as a catalyst of condensation polymerization reaction) | 2 parts |

(2) The reaction was further performed under a reduced pressure of from 5 to 20 mmHg;

(3) the resultant was removed when the acid value reached 35; and (4) subsequent to cooling down, the resultant was pulverized to obtain a linear polyester resin p(1).

The linear polyester resin P(1) did not contain components insoluble to tetrahydrofuran (THF) and had an acid value of 35, a hydroxyl group value of 25, a glass transition temperature (Tg) of 58° C., a softening point of 115° C., a number average molecular weight of 5,800, a weight average molecular weight of 20,000, and a peak top molecular weight of 9,400.

The softening temperature was measured according to the method described in JIS K7210 (Plastics—Determination of the melt mass-flow rate (MFR) and the melt volume-flow rate (MVR) of thermoplastics) by an elevated flow tester, manufactured by Shimazu Corporation. While a sample material of 1 $cm^3$ was heated at a pace of 6° C./minute, a load of 20 $Kg/cm^2$ was applied to the sample material by a plunger which functioned to squeeze the sample out of a nozzle having a diameter of 1 mm and a length of 1 mm. Thereby, a plunger-descending amount~temperature curve was drawn. When the height of the S-curve was set to be h, the softening point of the sample material was defined to be the temperature corresponding to h/2 (at which a half of the sample material flowed out).

The acid value was measured according to the method described in JIS K0070 (Test methods for acid value, saponification value, ester value, iodine value, hydroxyl value and unsaponifiable matter of chemical products).

The glass transition temperature was measured as follows: after a sample material was heated from room temperature to 200° C. at a pace of 10° C./minute and cooled down to room temperature at a pace of −10° C./minute, measurement was performed while raising the temperature at a pace of 10° C./minute. Its glass transition temperature was calculated based on the method according to JIS K7121 (Testing methods for transition temperatures of plastics).

(Manufacturing Master Batch)

Using the linear polyester resin P (1), each dye, the polyester resin, and purified water were mixed with the ratio of 1:1:0.5 and kneaded by a two roll kneading machine. Kneading was performed at 70° C. Thereafter, to evaporate purified water, the temperature of the rolls was raised to 120° C. to prepare a master batch of each color toner in advance:

Cyan Toner Master Batch-Recipe: (TB-C)

| | |
|---|---|
| Binder resin P(1) | 100 parts |
| Cyan dye (pigment blue 15-3) | 100 parts |
| Purified water | 50 parts |

Magenta Toner Master Batch Recipe: (TB-M)

| | |
|---|---|
| Binder resin P(1) | 100 parts |
| Magenta dye (pigment red 122) | 100 parts |
| Purified water | 50 parts |

Yellow Toner Master Batch Recipe: (TB-Y)

| | |
|---|---|
| Binder resin P(1) | 100 parts |
| Yellow dye (pigment yellow 180) | 100 parts |
| Purified water | 50 parts |

Black Toner Master Batch Recipe: (TB-K)

| | |
|---|---|
| Binder resin P(1) | 100 parts |
| Black dye (carbon black) | 100 parts |
| Purified water | 50 parts |

Example of Manufacturing a Hybrid Resin HB(1)

A hybrid resin HB(1) was obtained as follows:

(1) Set the following compounds in a dropping funnel;

| | |
|---|---|
| Styrene (functioning as a monomer for addition polymerization reaction) | 15 moles |
| Butyl methacrylate (functioning as a monomer for addition polymerization reaction) | 5 moles |
| t-butyl hydroperoxide (functioning as polymerization initializer) | 0.2 moles |

(2) Set the following compounds in a flask equipped with a stainless stirrer, a flow-down type condenser, a nitrogen gas introducing tube, and a temperature;

| | |
|---|---|
| Fumaric acid (functioning as a monomer for both addition polymerization and condensation polymerization | 15 moles |
| Trimellitic acid anhydride (functioning as a monomer for condensation polymerization) | 5 moles |
| Bisphenol A (2,2) propylene oxide (functioning as a monomer for condensation polymerization) | 5 moles |
| Bisphenol A (2,2) ethylene oxide(functioning as a monomer for condensation polymerization) | 4 moles |
| Dibutyl tin oxide (functioning as an esterization catalyst) | 6 moles |

(3) Drop the addition polymerization material mixed in advance to the material in the flask over a period of 5 hours while being stirred at 135° C. in nitrogen gas atmosphere;

(4) Thereafter, leave the resultant for 6 hours at 130° C.; and (5) Raise the temperature to 220° C. for reaction to obtain a hybrid resin HB(1).

The hybrid resin HB(1) did not contain a component insoluble to tetrahydrofuran (THF) and had an acid value of 30, a hydroxyl value of 40, a glass transition temperature (Tg) of 58° C., a softening point of 110° C., a number average molecular weight of 8,000, a weight average molecular weight of 29,000, and a peak top molecular weight of 7,500.

Manufacturing Toner

The toner of the present invention was manufactured as follows:

Cyan Toner Recipe

| | |
|---|---|
| Linear polyester resin P(1) | 67 parts |
| Hybrid resin HB(1) | 8 parts |
| Master batch (Tb-C) | 20 parts |
| E-84 (zinc (III) salicylic acid complex, manufactured by Orient Chemical Industries Co., Ltd.) | 2 parts |
| Carnauba wax (acid value: 5 mgKOH/g, Mw: 1,600) | 3 parts |

Magenta Toner Recipe

The recipe was the same as cyan toner recipe except that the number of parts of the master batch (TB-M) was changed to 18 parts, and the number of parts of the linear polyester resin P(1) was changed to 69 parts.

Yellow Toner Recipe

The recipe was the same as cyan toner recipe except that the number of parts of the master batch (TB-Y) was changed to 20 parts.

Black Toner Recipe

The recipe was the same as cyan toner recipe except that the number of parts of the master batch (TB-K) was changed to 16 parts, and the number of parts of the linear polyester resin P(1) was changed to 71 parts.

Using the same recipes as mentioned above, materials were preliminarily mixed by HENSCHEL MIXER (FM10B, manufactured by Mitsui Miike Machinery Co., Ltd.) and kneaded by a two-axis kneading machine (PCM-30, manufactured by Ikegai Corporation). Next, the resultant was finely-pulverized by a supersonic jet pulverizer LABOJET (manufactured by Nippon Pneumatic Mfg. Co., Ltd.) and classified by an air classifier (MDS-I, manufactured by Nippon Pneumatic Mfg. Co., Ltd.) to obtain a toner particle having a volume average particle diameter of 5.5 μm. Thereafter, 100 parts of the toner particle were mixed with 1.0 part of colloidal silica (H-2000, manufactured by Clariant Japan K.K.) by a sample mill to obtain the toner of the present invention. The toner of the present invention was mixed with silicone coated carrier having an average particle diameter of 50 μm with a toner density of 5% to obtain the developer of the present invention.

Example 2

Cyan Toner Recipe

| | |
|---|---|
| Linear polyester resin P(1) | 62 parts |
| Hybrid resin HB(1) | 10 parts |
| Master batch (Tb-C) | 20 parts |
| E-84 (zinc (III) salicylic acid complex, manufactured by Orient Chemical Industries Co., Ltd.) | 3 parts |
| Carnauba wax (acid value: 5 mgKOH/g, Mw: 1,600) | 5 parts |

Magenta Toner Recipe

The recipe was the same as cyan toner recipe except that the number of parts of the master batch (TB-M) was changed to 18 parts, and the number of parts of the linear polyester resin P(1) was changed to 64 parts.

Yellow Toner Recipe

The recipe was the same as cyan toner recipe except that the number of parts of the master batch (TB-Y) was changed to 20 parts.

Black Toner Recipe

The recipe was the same as cyan toner recipe except that the number of parts of the master batch (TB-K) was changed to 16 parts, and the number of parts of the linear polyester resin P(1) was changed to 66 parts.

Using the recipe mentioned in Example 1, a toner particle having a volume average particle diameter of 6.8 μm was obtained in the same manner as described in Example 1. Thereafter, 100 parts of the toner particle were mixed with 1.0 part of colloidal silica (H-2000, manufactured by Clariant Japan K.K.) by a sample mill to obtain the toner of the present invention. The toner of the present invention was mixed with silicone coated carrier having an average particle diameter of 50 μm with a toner density of 5% to obtain the developer of the present invention.

Example 3

Manufacturing of Non-Linear Polyester Resin NP(1)

(1) The following components were placed in a reacting container equipped with a condenser, a stirrer, and a nitrogen introducing tube and reacted for 10 hours at 230° C. eliminating water generated under nitrogen air flow;

| | |
|---|---|
| Adduct of bisphenol A with 2 moles of EO | 400 parts |
| Adduct of bisphenol A with 2 moles of PO | 280 parts |
| Terephthalic acid | 300 parts |
| Fumaric acid anhydride | 40 parts |
| Dibutyl tin oxide (functioning as a catalyst of condensation polymerization reaction) | 1.5 parts |

(2) The reaction was further performed under a reduced pressure of from 5 to 20 mmHg;

(3) When the resultant reached an acid value not greater than 2, the resultant was cooled down to 180° C.;

(4) Add 62 parts of ttrimellitic acid anhydride thereto;

(5) React under normal pressure in sealed condition for 2 hours;

(6) Remove and cool down the resultant to room temperature; and (7) Pulverize the resultant to obtain a non-linear polyester resin NP (1).

The non-linear polyester resin NP(1) contained components insoluble to tetrahydrofuran (THF) and its content was 5%. The non-linear polyester resin NP(1) had an acid value of 20, a hydroxyl group value of 47, a glass transition temperature (Tg) of 64° C., a softening point of 125° C., a number average molecular weight of 4,100, and a weight average molecular weight of 75,000, and a peak top molecular weight of 10,200.

Cyan Toner Recipe:

| | |
|---|---|
| Linear polyester resin P(1) | 28 parts |
| Non-linear polyester resin NP(1) | 30 parts |
| Hybrid resin H(1) | 7 parts |
| Master batch (TB-C) | 20 parts |
| Copy charge NX VP434 (manufactured by Hoechst AG) | 5 parts |
| Carnauba wax (acid value: 5 mgKOH/g, Mw: 1,600) | 10 parts |

Magenta Toner Recipe:

The recipe was the same as cyan toner recipe except that the number of parts of the master batch (TB-M) was changed to 18 parts, and the number of parts of the linear polyester resin P (1) was changed to 30 parts.

Yellow Toner Recipe

The recipe was the same as cyan toner recipe except that the number of parts of the master batch (TB-Y) was changed to 20 parts.

Black Toner Recipe

The recipe was the same as cyan toner recipe except that the number of parts of the master batch (TB-K) was changed to 16 parts, and the number of parts of the linear polyester resin P(1) was changed to 32 parts.

Using the recipe mentioned above, a toner particle having a volume average particle diameter of 7.2 μm was obtained in the same manner as described in Example 1. Thereafter, 100 parts of the toner particle were mixed with 1.0 part of colloidal silica (H-2000, manufactured by Clariant Japan K.K.) by a sample mill to obtain the toner of the present invention. The toner of the present invention was mixed with silicone coated carrier having an average particle diameter of 50 μm with a toner density of 5% to obtain the developer of the present invention.

Example 4

Synthesis of Linear Polyester Resin P(2)

(1) The following components were placed in a reacting container equipped with a condenser, a stirrer and a nitrogen introducing tube and reacted for 10 hours at 220° C. eliminating water generated under nitrogen air flow;

| | |
|---|---|
| Adduct of bisphenol A with 2 moles of EO | 430 parts |
| Adduct of bisphenol A with 2 moles of PO | 300 parts |
| Terephthalic acid | 200 parts |
| Fumaric acid | 50 parts |
| Dibutyl tin oxide (functioning as a catalyst of condensation polymerization reaction) | 3 parts |

(2) The reaction was further performed under a reduced pressure of from 5 to 20 mmHg;

(3) The resultant was removed when the acid value reached 4; and (4) Subsequent to cooling down to room temperature, the resultant was pulverized to obtain a linear polyester resin p(2).

The linear polyester resin P(2) did not contain components insoluble to tetrahydrofuran (THF) and had an acid value of 4, a hydroxyl group value of 15, a glass transition temperature (Tg) of 60° C., a softening point of 105° C., a number average molecular weight of 3,200, a weight average molecular weight of 12,000, and a peak top molecular weight of 8,800.

(Manufacturing Master Batch)

Using the linear polyester resin P(2), each dye, the polyester resin, and purified water were mixed with the ratio of 1:1:0.5 and kneaded by a two roll kneading machine. Kneading was performed at 70° C. Thereafter, to evaporate purified water, the temperature of the rolls was raised to 120° C. to prepare a master batch of each color toner in advance:

Cyan Toner Master Batch Recipe: (TB-C2)

| | |
|---|---|
| Binder resin P(2) | 100 parts |
| Cyan dye (pigment blue 15-3) | 100 parts |
| Purified water | 50 parts |

Magenta Toner Master Batch Recipe: (TB-M2)

| | |
|---|---|
| Binder resin P(2) | 100 parts |
| Magenta dye (pigment red 122) | 100 parts |
| Purified water | 50 parts |

Yellow Toner Master Batch Recipe: (TB-Y2)

| | |
|---|---|
| Binder resin P(2) | 100 parts |
| Yellow dye (pigment yellow 180) | 100 parts |
| Purified water | 50 parts |

Black Toner Master Batch Recipe: (TB-K2)

| | |
|---|---|
| Binder resin P(2) | 100 parts |
| Black dye (carbon black) | 100 parts |
| Purified water | 50 parts |

Cyan Toner Recipe:

| | |
|---|---|
| Linear polyester resin P(2) | 21 parts |
| Non-linear polyester resin NP(1) | 20 parts |
| Hybrid resin H(1) | 27 parts |
| Master batch (TB-C2) | 20 parts |
| Copy charge NX VP434 (manufactured by Hoechst AG) | 3 parts |
| Carnauba wax (acid value: 5 mgKOH/g, Mw: 1,600) | 9 parts |

Magenta Toner Recipe:

The recipe was the same as cyan toner recipe except that the number of parts of the master batch (TB-M2) was changed to 18 parts, and the number of parts of the linear polyester resin P(2) was changed to 23 parts.

Yellow Toner Recipe

The recipe was the same as cyan toner recipe except that the number of parts of the master batch (TB-Y2) was changed to 20 parts.

Black Toner Recipe

The recipe was the same as cyan toner recipe except that the number of parts of the master batch (TB-K2) was changed to 16 parts, and the number of parts of the linear polyester resin P(2) was changed to 25 parts.

Using the recipe mentioned above, a toner particle having a volume average particle diameter of 3.5 μm was obtained in the same manner as described in Example 1. Thereafter, 100 parts of the toner particle were mixed with 2.0 part of colloidal silica (H-2000, manufactured by Clariant Japan K.K.) by a sample mill to obtain the toner of the present invention. The toner of the present invention was mixed with acrylic resin coated carrier having an average particle diameter of 30 μm with a toner density of 8% to obtain the developer of the present invention.

Example 5

Cyan Toner Recipe

| | |
|---|---|
| Linear polyester resin P(2) | 25 parts |
| Non-linear polyester resin NP(1) | 30 parts |
| Hybrid resin H(1) | 15 parts |
| Master batch (TB-C2) | 20 parts |

-continued

| | |
|---|---|
| TN-105 (salicylic acid zirconium complex, manufactured by Hodogaya Chemical Co., Ltd. | 3 parts |
| Carnauba wax (acid value: 5 mgKOH/g, Mw: 1,600) | 7 parts |

Magenta Toner Recipe:

The recipe was the same as cyan toner recipe except that the number of parts of the master batch (TB-M2) was changed to 18 parts, and the number of parts of the linear polyester resin P(2) was changed to 27 parts.

Yellow Toner Recipe

The recipe was the same as cyan toner recipe except that the number of parts of the master batch (TB-Y2) was changed to 20 parts.

Black Toner Recipe

The recipe was the same as cyan toner recipe except that the number of parts of the master batch (TB-K2) was changed to 16 parts, and the number of parts of the linear polyester resin P(2) was changed to 29 parts.

Using the recipe mentioned above, a toner particle having a volume average particle diameter of 2.5 μm was obtained in the same manner as described in Example 1. Thereafter, 100 parts of the toner particle were mixed with 3.0 part of colloidal silica (H-2000, manufactured by Clariant Japan K.K.) by a sample mill to obtain the toner of the present invention. The toner of the present invention was mixed with acrylic resin coated carrier having an average particle diameter of 30 μm with a toner density of 8% to obtain the developer of the present invention.

Example 6

Cyan Toner Recipe

| | |
|---|---|
| Linear polyester resin P(2) | 30 parts |
| Non-linear polyester resin NP(1) | 30 parts |
| Hybrid resin H(1) | 5 parts |
| Master batch (TB-C2) | 20 parts |
| TN-105 (salicylic acid zirconium complex, manufactured by Hodogaya Chemical Co., Ltd. | 5 parts |
| Carnauba wax (acid value: 5 mgKOH/g, Mw: 1,600) | 10 parts |

Magenta Toner Recipe:

The recipe was the same as cyan toner recipe except that the number of parts of the master batch (TB-M2) was changed to 20 parts.

Yellow Toner Recipe

The recipe was the same as cyan toner recipe except that the number of parts of the master batch (TB-Y2) was changed to 20 parts.

Black Toner Recipe

The recipe was the same as cyan toner recipe except that the number of parts of the master batch (TB-K2) was changed to 16 parts, and the number of parts of the linear polyester resin P(2) was changed to 34 parts.

Using the recipe mentioned above, a toner particle having a volume average particle diameter of 6.2 μm was obtained in the same manner as described in Example 1. Thereafter, 100 parts of the toner particle were mixed with 2.0 part of colloidal silica (H-2000, manufactured by Clariant Japan K.K.) by a sample mill to obtain the toner of the present invention. The toner of the present invention was mixed with acrylic resin coated carrier having an average particle diameter of 30 μm with a toner density of 8% to obtain the developer of the present invention.

Comparative Example 1

Cyan Toner Recipe

| | |
|---|---|
| Linear polyester resin P(2) | 30 parts |
| Non-linear polyester resin NP(1) | 30 parts |
| Hybrid resin H(1) | 3 parts |
| Master batch (TB-C2) | 20 parts |
| TN-105 (salicylic acid zirconium complex, manufactured by Hodogaya Chemical Co., Ltd. | 7 parts |
| Carnauba wax (acid value: 5 mgKOH/g, Mw: 1,600) | 10 parts |

Magenta Toner Recipe:

The recipe was the same as cyan toner recipe except that the number of parts of the master batch (TB-M2) was changed to 20 parts.

Yellow Toner Recipe

The recipe was the same as cyan toner recipe except that the number of parts of the master batch (TB-Y2) was changed to 20 parts.

Black Toner Recipe

The recipe was the same as cyan toner recipe except that the number of parts of the master batch (TB-K2) was changed to 16 parts, and the number of parts of the linear polyester resin P(2) was changed to 34 parts.

Using the recipe mentioned above, a toner particle having a volume average particle diameter of 4.2 μm was obtained in the same manner as described in Example 1. Thereafter, 100 parts of the toner particle were mixed with 2.0 part of colloidal silica (H-2000, manufactured by Clariant Japan K.K.) by a sample mill to obtain the toner of the present invention. The toner of the present invention was mixed with acrylic resin coated carrier having an average particle diameter of 30 μm with a toner density of 8% to obtain the developer of the present invention.

Comparative Example 2

Cyan Toner Recipe

| | |
|---|---|
| Linear polyester resin P (2) | 20 parts |
| Non-linear polyester resin NP (1) | 30 parts |
| Hybrid resin H (1) | 20 parts |
| Master batch (TB-C2) | 20 parts |
| TN-105 (salicylic acid zirconium complex, manufactured by Hodogaya Chemical Co., Ltd. | 5 parts |
| Carnauba wax (acid value: 5 mgKOH/g, Mw: 1,600) | 5 parts |

Magenta Toner Recipe:

The recipe was the same as cyan toner recipe except that the number of parts of the master batch (TB-M2) was changed to 20 parts.

Yellow Toner Recipe

The recipe was the same as cyan toner recipe except that the number of parts of the master batch (TB-Y2) was changed to 20 parts.

Black Toner Recipe

The recipe was the same as cyan toner recipe except that the number of parts of the master batch (TB-K2) was changed to 16 parts, and the number of parts of the linear polyester resin P(2) was changed to 24 parts.

Using the recipe mentioned above, a toner particle having a volume average particle diameter of 5.1 μm was obtained in the same manner as described in Example 1. Thereafter, 100 parts of the toner particle were mixed with 2.0 part of colloidal silica (H-2000, manufactured by Clariant Japan K.K.) by a sample mill to obtain the toner of the present invention. The toner of the present invention was mixed with acrylic resin coated carrier having an average particle diameter of 30 μm with a toner density of 8% to obtain the developer of the present invention.

Toner Evaluation Method

Anti-Hot Offset Property

A machine remodeled from a color photocopier imagio neo C385, manufactured by Ricoh Co., was used under the condition that oil is not applied to the fixing belt. While changing the temperature of the fixing belt at an interval of 5° C., the temperature at which offset started to occur was measured. Ricoh full color PPC paper type 6000<70W> was used as a transfer paper. The evaluation result is shown as follows:

The conditions for the fixing belt was:

| |
|---|
| Fixing belt: Belt diameter: 60,<br>Substrate: Nickel having a thickness of about 40 μm,<br>Release layer: PFA having a thickness of 20 μm was coated on silicone rubber having a thickness about 150 μm<br>Belt tension: 1.5 Kg/piece<br>Belt speed: 180 mm/sec<br>Fixing nip width: 10 mm<br>Heater power: Heating: 650 W, Pressure: 400 W<br>Fixing pressure (Total pressure): 40 Kg |

a certain pressure. Thereafter, the mending tape was slowly peeled off. The image density before attaching the mending tape and after peeling off the mending tape was measured by a Macbeth densitometer and the fixing ratio was calculated using the following relationship: Fixing ratio (%)={(image density after peeling off the tape)/(image density)}×100, where the image density represents the image density obtained before the mending tape was attached). The temperature at the fixing roller was decreased in a stepwise manner and the temperature at when the fixing ratio shown by the relationship mentioned above was not greater than 80% was defined to be the fixing temperature.

The toners mentioned above were set in a color laser printer IPSiO CX-8200, manufactured by Ricoh Co., for evaluation. Since this color printer takes an oil application fixing system, when the toner containing wax was evaluated, the fixing portion was remodeled for an oilless fixing system. In addition, since the color printer takes a developing system in which a two-component developer is used, the toner agglomeration body generated in the developing portion was evaluated.

For each color toner, i.e., yellow, cyan, magenta, and black, a 5,000 A4-sized sheet running was performed with an image area of 5% in an environment where the temperature was 30° C. and the humidity was 80%. Thereafter, two A3-sized sheet solid images were output for each color, i.e., yellow, cyan, magenta, and black, and the number of toner agglomeration bodies on the solid images were counted.

The evaluation results of the toner of Examples 1 to 6 and Comparative Examples 1 and 2 are shown in Table 1.

TABLE 1

| | Example 1 | Example 2 | Example 3 | Example 4 | Example 5 | Example 6 | Comparative Example 1 | Comparative Example 2 |
|---|---|---|---|---|---|---|---|---|
| Fixing property: ° C. | 140 | 140 | 135 | 130 | 130 | 130 | 165 | 160 |
| Anti-hot offset property: ° C. | 190 | 195 | 200 | 205 | 210 | 210 | 190 | 200 |
| Gloss level | 15 | 13 | 12 | 10 | 9 | 8 | 3 | 2 |
| Number of agglomeration bodies | 5 | 5 | 3 | 0 | 0 | 0 | 25 | 35 |

Gloss Level

The machine mentioned above, which was remodeled from a color photocopier imagio neo C385, manufactured by Ricoh Co., was used. Development was controlled such that the amount of toner used was 0.9 to 1.1 mg/cm$^2$. When the surface temperature of the fixing belt was 160° C., the gloss level of a sample solid image was measured by a gloss meter manufactured by Nippon Denshoku Industries Co., Ltd., with an angle of incidence of 60°.

Fixing Property

The machine used for evaluating anti-hot offset was machine remodeled from a color photocopier imagio neo C385, manufactured by Ricoh Co. While changing the temperature of the fixing belt at an interval of 5° C., copies were made to obtain fixed images. Mending tape (manufactured by Sumitotmo 3M limited) was attached to the fixed image with This document claims priority and contains subject matter related to Japanese Patent Application No. 2004-227177 filed on Aug. 3, 2005, the entire contents of which are hereby incorporated herein by reference.

Having now fully described embodiments of the present invention, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. A toner, comprising:

a binder resin, comprising:

a polyester resin comprising a linear polyester resin and a non-linear polyester resin;

18.3 to 34.6% by weight, based on total binder resin, of a hybrid resin, comprising:

a vinyl group polymer unit; and a polyester unit;

a release agent; and a colorant;

wherein a content A of the hybrid resin and a content B of the release agent satisfy the following relationship 1:

$$B/2 \leqq A \leqq 3B \quad \text{(relationship 1);}$$

wherein, when a softening point of the non-linear polyester resin is C, a softening point of the linear polyester resin is D and a softening point of the hybrid resin is E, the following relationships 2 are satisfied:

$$C > E > D,$$

$$5 \leqq C - D \leqq 25, \text{ and}$$

$$C \leqq 130^\circ\ C. \quad \text{(relationships 2).}$$

2. The toner according to claim 1, wherein the content B of the release agent is from 3.5 to 10 weight % based on a weight of the toner.

3. The toner according to claim 1, wherein an acid value of the non-linear polyester resin is F, an acid value of the linear polyester resin is G and an acid value of the hybrid resin is H, the following relationships 3 are satisfied:

$$H > F \text{ and } H > G \quad \text{(relationship 3).}$$

4. The toner according to claim 1, wherein the release agent comprises at least one of carnauba wax, montan wax, and oxidized rice wax.

5. The toner according to claim 1, wherein a mixture of a material monomer of a condensation polymerization resin and a material monomer of an addition polymerization resin is used to obtain the hybrid resin by performing at least one of simultaneous reactions of condensation polymerization and addition polymerization of the mixture in a same reaction container and independent reactions thereof.

6. The toner according to claim 1, further comprising a trivalent or higher salicylic acid metal compound, and wherein the hybrid resin has an acid value of from 15 to 70 mg[KOH]/g.

7. The toner according to claim 1, wherein the toner has a volume average particle diameter of from 2.5 to 7 μm.

8. The toner according to claim 1, wherein a content of the colorant in the toner is not less than 7 weight % based on a weight of the toner.

9. A fixing method, comprising:

fixing a toner image on a recording material upon application of heat and pressure by a fixed heater, a heating material having one of an endless belt form and a belt form having an end which is located opposing the fixed heater and heated thereby, and a pressing member configured to press the recording material against the heating material, wherein the toner is the toner according to claim 1.

10. A two-component developer, comprising:

a carrier; and the toner according to claim 1.

* * * * *